US007184679B2

(12) United States Patent
Wu et al.

(10) Patent No.: US 7,184,679 B2
(45) Date of Patent: Feb. 27, 2007

(54) RECEIVER MEMBER SPEED CONTROL THROUGH A FUSER ASSEMBLY OF A REPRODUCTION APPARATUS

(75) Inventors: Fangsheng Wu, Rochester, NY (US); Muhammed Aslam, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/117,557

(22) Filed: Apr. 28, 2005

(65) Prior Publication Data

US 2006/0245776 A1 Nov. 2, 2006

(51) Int. Cl.
*G03G 15/20* (2006.01)

(52) U.S. Cl. ..... 399/68

(58) Field of Classification Search ..... 399/68, 399/45, 400, 320, 328, 331; 219/216, 469, 219/388; 430/124
See application file for complete search history.

(56) References Cited

U.S. PATENT DOCUMENTS 5,819,149 A * 10/1998 Watanabe et al. ..... 399/330
5,956,543 A * 9/1999 Aslam et al. ..... 399/45
6,463,250 B1 * 10/2002 Chen et al. ..... 399/330
6,549,745 B2 * 4/2003 May et al. ..... 399/302
6,556,798 B2 * 4/2003 Rimai et al. ..... 399/167
6,799,000 B2 * 9/2004 Aslam et al. ..... 399/45
6,816,686 B2 * 11/2004 Hooper et al. ..... 399/44

* cited by examiner

*Primary Examiner*—Robert Beatty
(74) *Attorney, Agent, or Firm*—Lawrence P. Kessler

(57) ABSTRACT

A speed control mechanism for a reproduction apparatus including a fuser assembly having pressure, applying members in nip relation to apply pressure to a receiver member bearing a marking particle image to fuse such marking particle image to such receiver member transported through the fuser assembly. The speed control mechanism has an input device for storing parameters required for fusing particular types of receiver members under various desired conditions, and a device for determining fuser control parameters, including overdrive effect, based on information from the input device and selection of a particular receiver member type and certain conditions. A fuser assembly controller then sets fusing parameters based on the determination by the determining device, and adjusts the transport speed of a receiver member through the fuser assembly to compensate for the determined overdrive effect.

7 Claims, 4 Drawing Sheets

RECEIVER MEMBER SPEED CONTROL THROUGH A FUSER ASSEMBLY OF A REPRODUCTION APPARATUS

FIELD OF THE INVENTION

This invention relates in general to a fuser assembly for an electrographic reproduction apparatus, and more particularly to a receiver member speed control through the fuser assembly.

BACKGROUND OF THE INVENTION

In typical commercial reproduction apparatus (electrostatographic copier/duplicators, printers, or the like), a latent image charge pattern is formed on a uniformly charged charge-retentive or photoconductive member having dielectric characteristics (hereinafter referred to as the dielectric support member). Pigmented marking particles are attracted to the latent image charge pattern to develop such image on the dielectric support member. A receiver member, such as a sheet of paper, transparency or other medium, is then brought into contact with the dielectric support member, and an electric field applied to transfer the marking particle developed image to the receiver member from the dielectric support member. After transfer, the receiver member bearing the transferred image is transported away from the dielectric support member, and the image is fixed (fused) to the receiver member by application of heat and pressure to form a permanent reproduction thereon.

One type of fuser assembly for typical reproduction apparatus includes at least one heated roller, having an aluminum core and an elastomeric cover layer, and at least one pressure roller in nip relation with the heated roller. The fuser assembly rollers are rotated to transport a receiver member, bearing a marking particle image, through the nip between the rollers. The pigmented marking particles of the transferred image on the surface of the receiver member soften and become tacky in the heat. Under the pressure, the softened tacky marking particles attach to each other and are partially imbibed into the interstices of the fibers at the surface of the receiver member. Accordingly, upon cooling, the marking particle image is permanently fixed to the receiver member.

In the fuser assembly, at least one of the fuser and pressure rollers is compliant. Further, one of the fuser and pressure rollers, is driven by a driving motor (designated as the driving roller), and the other roller is driven by the friction in the nip (designated the driven roller). In the nip region, the compliant, uncompressible materials on the fuser and/or the pressure rollers are stressed and strained under pressure. This causes a phenomenon called "overdrive," in which a segment along a linear element on the compliant surface of the roller in the nip region goes faster than a segment along a linear element on the free surface of the roller. The thicker the compliant, uncompressible material on a roller, the more the overdrive. The overdrive causes the receiver member being transported in the nip to go faster than the roller free surface speed.

Once the thickness of the compliant, uncompressible materials on the fuser and pressure rollers are determined, the factor that can affect the overdrive the most is the pressure applied to the fuser/pressure roller nip, or equivalently the nip width. In the process of fixing the toner image permanently to the receiver, it is sometime necessary to adjust nip width for different receiver member thickness, different image gloss level, and/or compensating temperature variation. This can cause varying receiver member speed through the fuser assembly. Because the reproduction apparatus process speed is usually fixed, this varying receiver member speed through the fuser assembly may cause speed mismatch with the surrounding reproduction apparatus sub-systems and components. The resultant speed mismatch problem may include pulling/pushing of the receiver member, distortion to the image and/or the receiver member, triggering false jam detection, or actually causing a jam. Therefore, there is a need to compensate for this speed variation at fusing station.

SUMMARY OF THE INVENTION

It is the purpose of this invention to compensate for receiver member speed variation through a reproduction apparatus fuser assembly due to overdrive characteristics of the driving roller of the fuser assembly, obtained experimentally or analytically, by adjusting the driving motor speed based on the load (or pressure, nip width). A speed control mechanism is provided for a reproduction apparatus including a fuser assembly having pressure applying members in nip relation to apply pressure to a receiver member bearing a marking particle image to fuse such marking particle image to such receiver member transported through the fuser assembly. The speed control mechanism has an input device for storing parameters required for fusing particular types of receiver members under various desired conditions, and a device for determining fuser control parameters, including overdrive effect, based on information from the input device and selection of a particular receiver member type and certain conditions. A fuser assembly controller then sets fusing parameters based on the determination by the determining device, and adjusts the transport speed of a receiver member through the fuser assembly to compensate for the determined overdrive effect.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
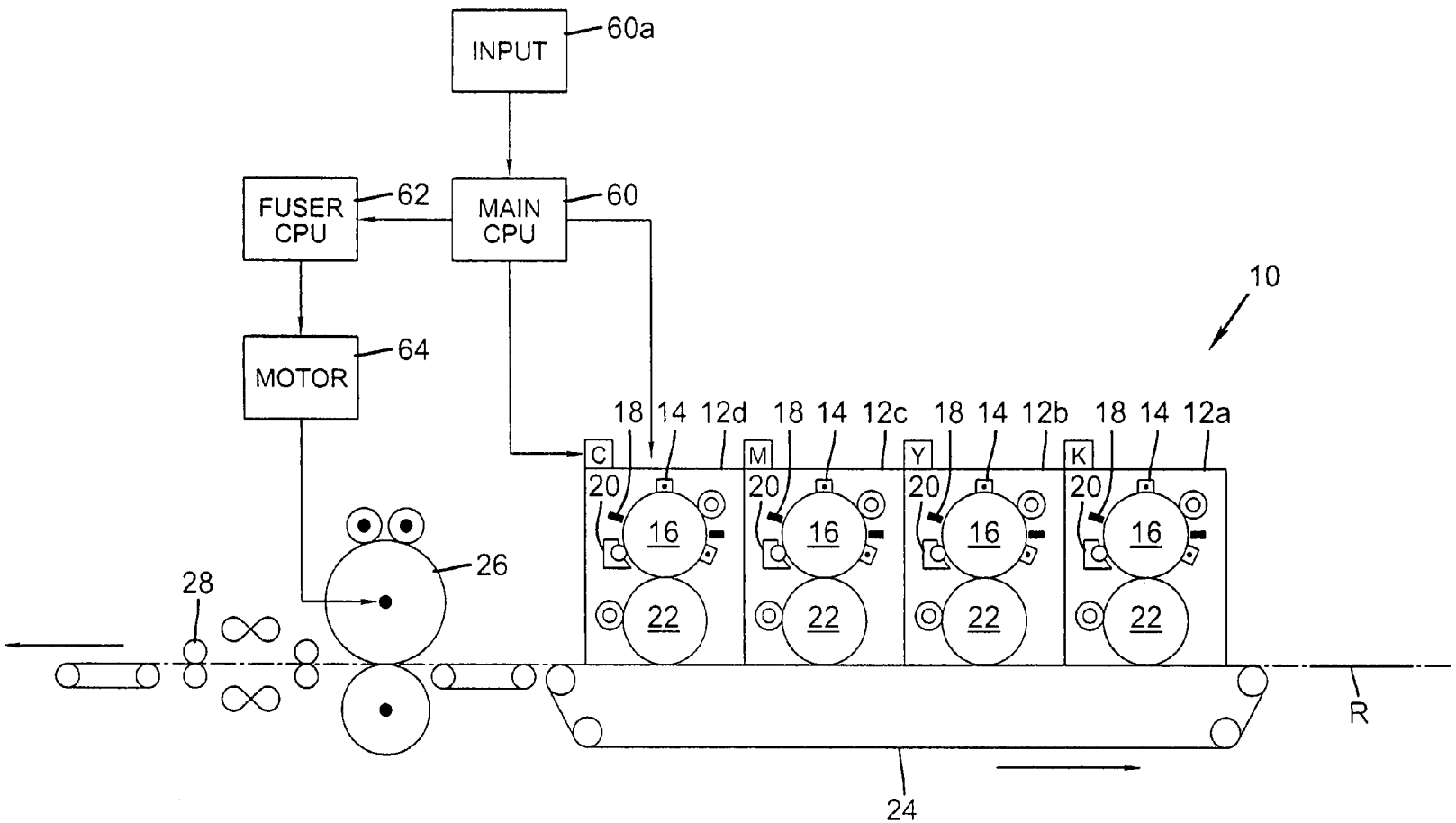
FIG. 1 is a schematic illustration of an exemplary reproduction apparatus, with portions removed to facilitate viewing, such reproduction apparatus including a fuser assembly utilizing a receiver member speed compensation control according to this invention.

An exemplary reproduction apparatus, designated generally by the numeral 10, is schematically shown in FIG. 1. The reproduction apparatus 10 includes a plurality of printing modules 12*a* through 12*d*, which enable the reproduction apparatus 10 to produce color prints. In each of the printing modules 12*a* through 12*d*, a uniform charge, is deposited by any suitable charging device 14 on a charge-retentive or photoconductive member having dielectric characteristics (hereinafter referred to as the dielectric support member 16). A latent image charge pattern (e.g., a color separation image) is formed on the uniformly charged dielectric support member 16 by any suitable exposure device, such as an LED print head 18. Correspondingly colored pigmented marking particles in an associated developer station 20 are attracted to the latent image charge pattern to develop such image on the respective dielectric support member 16. The developed image is transferred to an intermediate transfer member 22. A receiver member R, such as a sheet of paper, transparency or other medium, is transported by a moving belt 24 into contact with the intermediate transfer member 22 of each of the printing modules 12*a* through 12*d*, and an electric field is applied to respectively transfer the marking particle developed images to the receiver member R from the intermediate transfer member to form a full color print.

After transfer, a receiver member bearing the transferred composite image is transported by belt 24 away from the last printing module to a fuser assembly 26 where the composite image is fixed (fused) to the receiver member by application of heat and pressure to form a permanent reproduction thereon. The speed of the fuser roller is controlled by a drive motor 64. A main reproduction apparatus controller 60 receives data from an input data storage device 60*a*. The input data includes parameters required for fusing particular receiver members under various conditions, and provides such parameters based on the particular receiver member, for transmission to a fuser assembly controller 62. The parameters can include nip pressure, nip width, temperature, and transport speed, which may vary for each receiver member type and desired operating condition such as the desired gloss for example. The fuser assembly controller 62 can then get, or calculate, the load or nip required for proper fusing. The controllers 60 and 62 may be any suitable well-known microprocessor-based devices capable of processing input data, determining related operating parameters, and setting the required fuser assembly control based on the determined parameters. Of course, the controllers 60 and 62 could, alternatively, be combined into a single controller. Thereafter, the print is transported to a remote collection location by any suitable transport mechanism 28.

Figure 2:
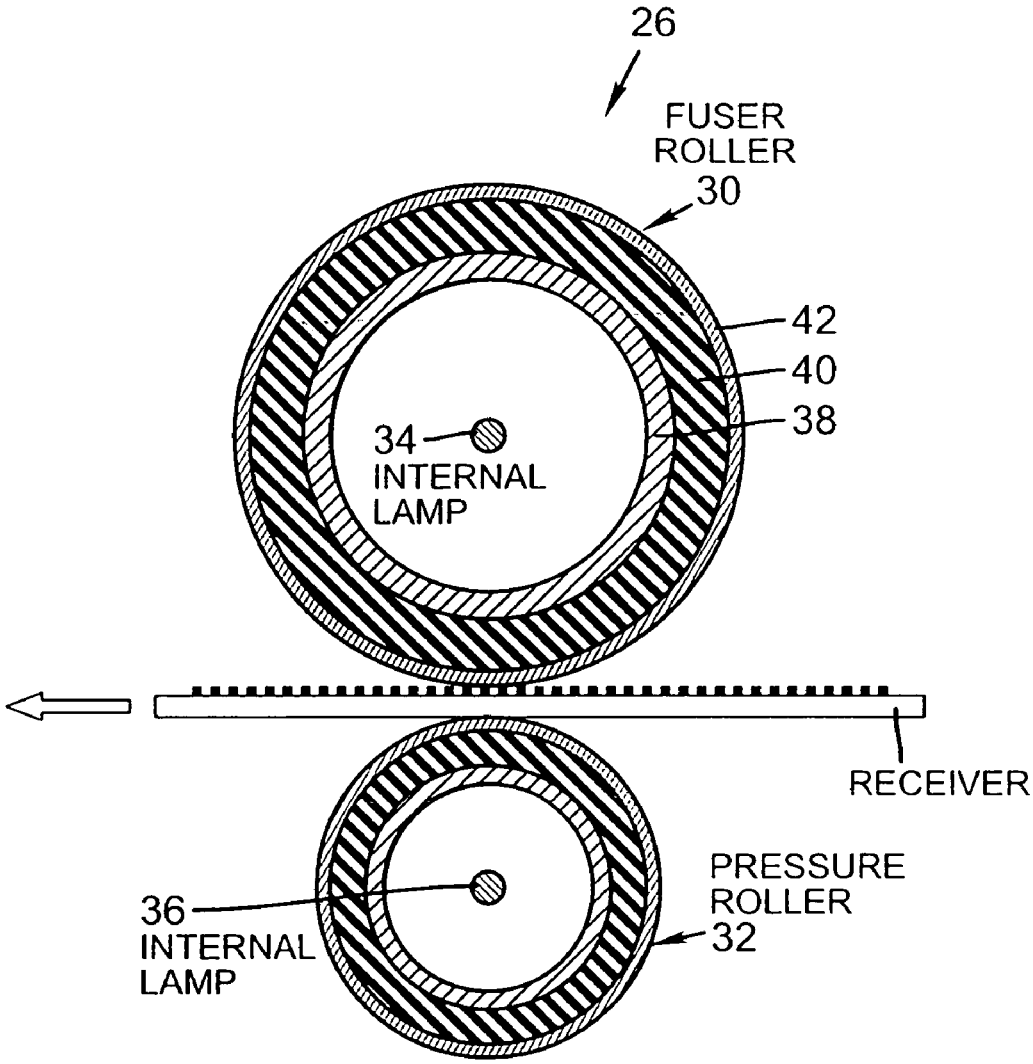
FIG. 2 is a schematic side elevational view of the fuser assembly of FIG. 1, utilizing a receiver member speed compensation control.

The fuser assembly 26 for the reproduction apparatus 10 is best shown in FIG. 2. The roller fuser assembly 26 includes a fuser roller 30, a pressure roller 32, and other necessary sub-systems and components (not shown). The fuser roller 30 (or both rollers 30 and 32) is heated internally (for example by respective lamps 34, 36), and/or externally for example by heater rollers (not shown), to pre-set temperatures. When fusing prints on receiver members R, the fuser roller 30 and the pressure roller 32 are pressed together to form a nip, and rotation of the rollers drive receiver member prints through the nip. In the nip, heat energy stored in the fuser roller 30 is transferred to the prints, and heats up and melts the marking particle image carried by a receiver member. Under the influence of the temperature and pressure, the marking particle print image is fixed on the receiver member R.

Generally the fuser roller 30 has a metal core 38, a compliant uncompressible base cushion 40, and a thin release topcoat 42. The base cushion 40 is formed of an elastomeric material. A thicker base cushion makes the geometry in the nip area more favorable for the receiver member R to be released from the fuser roller 30, but makes the heat more difficult to transfer from the metal core 38 to the outer surface of the topcoat 42.

As noted above, because of the nature of the compliant, uncompressible materials of the fuser roller 30, in the nip region, the fuser and/or the pressure rollers are stressed and strained under pressure. As a result, a receiver member passing through the nip is subject to overdrive due to the fact that a segment along a linear element on the compliant surface of the roller in the nip region goes faster than a segment along a linear element on the free surface of the roller. The thicker the compliant, uncompressible material on a roller, the more the overdrive effect. The overdrive effect causes the receiver member being transported through the nip to go faster than the roller free surface speed.

Figure 3:
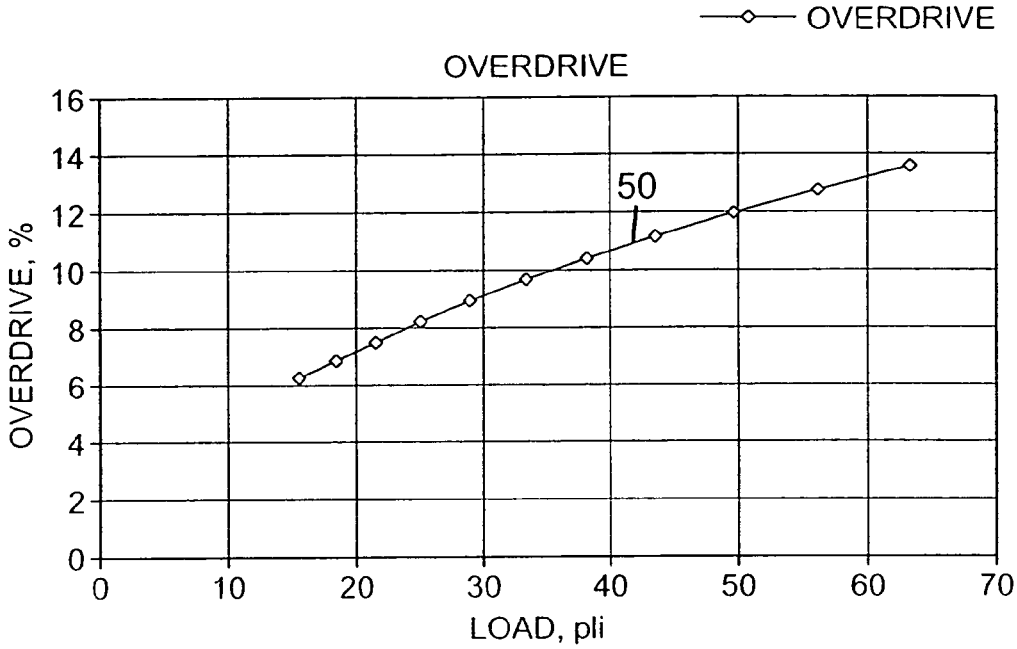
FIG. 3 is a graph of fuser assembly nip load vs. receiver member overdrive.
Figure 4:
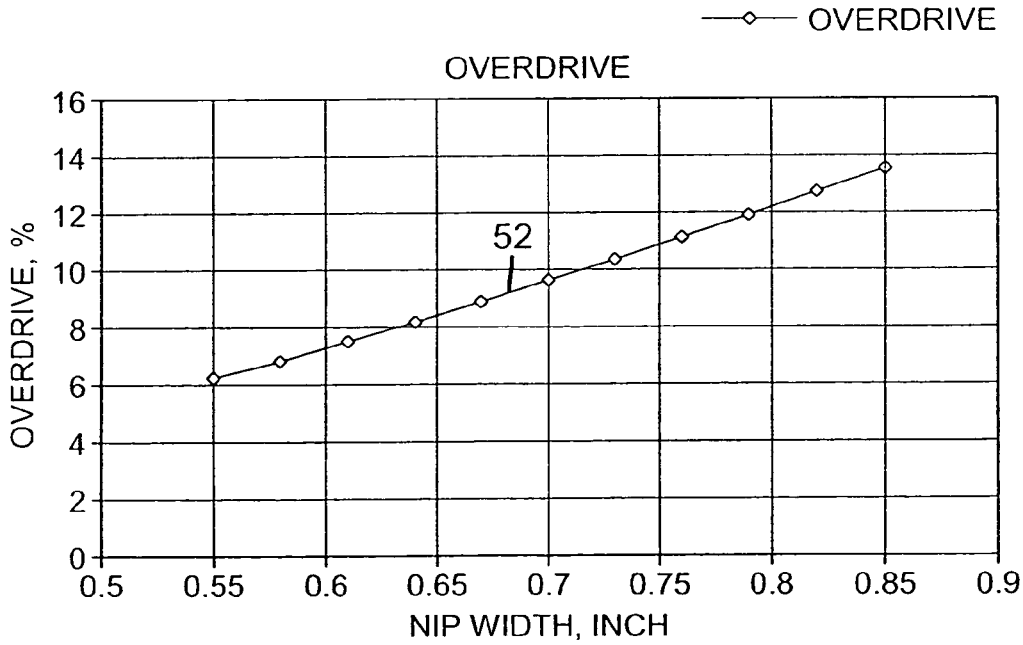
FIG. 4 is a graph of fuser assembly nip width vs. receiver member overdrive.

FIG. 3 is a graph showing a load-overdrive curve 50 of one example case. As can be determined from the curve 50, as the load in the fuser nip region increases, the overdrive effect increases. Particularly, a load in the nip of approximately 15 pounds per linear inch yields an overdrive effect increase of approximately 6%; and a load in the nip of approximately 60 pounds per linear inch yields an overdrive effect increase of approximately 13%. As stated above, pressure in the nip directly impacts the nip width. That is to say, as the pressure increases the nip width increases. Accordingly, as shown in FIG. 4, a curve 52 therein represents a nip width-overdrive effect relationship of one example case. Particularly, a nip width of approximately 0.55 inches yields an overdrive effect increase of approximately 6%; and a nip width of approximately 0.85 inches yields an overdrive effect increase of approximately 13.5%. Knowing the overdrive effect enables an equivalent speed compensation to be calculated.

Figure 5:
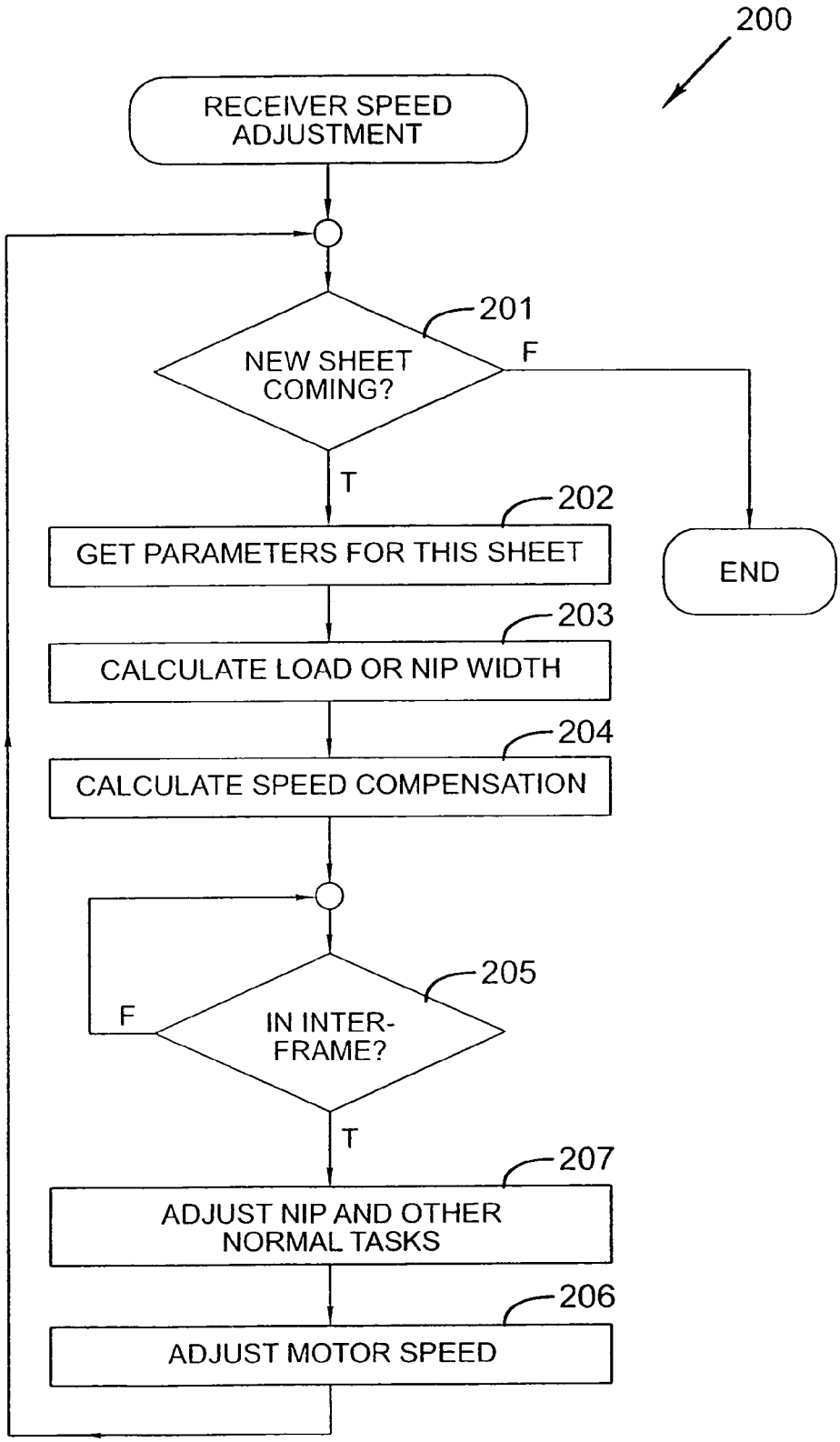
FIG. 5 is a flow chart of the receiver member speed compensation control according to this invention.

Referring to FIG. 5, a flow chart of the control process in order to compensate for receiver member speed variation through a reproduction apparatus fuser assembly due to the overdrive effect characteristics of the driving roller of the fuser assembly, designated generally by the numeral 200, is shown. It is noted that other minor factors that may affect the overdrive effect, such as roller temperatures, oil amount, paper type and surface coat type, can also be included in the control process. When it is determined that a receiver member R is being transported to the fuser assembly 12 (step 201), a main reproduction apparatus controller 60 receives data from an input data storage device 60*a* for the physical characteristics of the particular receiver member (step 202) for transmission to a fuser assembly controller 62. The fliser assembly controller 62 can then get, or calculate, the load or nip required for proper fusing (step 203). As noted above, the two controllers could be combined into a single controller. According to the determined nip load or nip width, the fuser assembly controller 62 calculates the overdrive effect compensation requirement (step 204).

Once a previous receiver member has passed through the fuser assembly roller nip, and the fuser roller 30 and the pressure roller 32 are in direct nip contact (that is, are within the inter-frame between the previous receiver member and a subsequent receiver member (step 205)), the fuser assembly controller 62 adjusts the speed of the fuser roller drive motor 64 (step 206) by decreasing the motor speed by an appropriate percentage, such as determined from the graphs of FIG. 3 or FIG. 4. Of course, depending on operating parameters, and system geometry, overdrive speed compensation could require that the fuser roller drive motor increase the fuser roller speed. When such subsequent receiver member then arrives at the nip, it will be controlled to be transported at a proper (compensated) speed. It has been found that the overdrive compensation range needs to be controlled at least from about 6% to 14%. Additionally, other adjustments of the fuser roller assembly nip or other normal fuser assembly tasks, can be accomplished by the fuser assembly controller 62 substantially with the motor speed adjustment (step 207).

As a result of the receiver member speed compensation control according to this invention, receiver members are transported smoothly through the fuser assembly. Reliability of the receiver member transport is markedly improved by substantially reducing the speed mismatch problem so that pulling/pushing of the receiver member is prevented, as is distortion to the image and/or the receiver member. Furthermore, there is no triggering of false jam detection, or actual jams.

The invention has been described in detail with particular reference to certain preferred embodiments thereof, but it will be understood that variations and modifications can be effected within the spirit and scope of the invention.

PARTS LIST

10 Reproduction apparatus
12*a*–12*d* Printing modules
14 Charging device
16 Dielectric support member
18 LED print head
20 Developer station
22 Intermediate transfer member
24 Moving belt
26 Fuser Assembly
28 Transport mechanism
30 Fuser roller
32 Pressure roller
34, 36 Lamps
38 Metal core
40 Base cushion
42 Release topcoat
50 Load—overdrive curve
52 Nip width overdrive curve
60 Main reproduction apparatus controller
60*a* Input data storage device
62 Fuser assembly controller
64 Drive motor
200 Flow chart
201–207 Flow chart steps
R Receiver member

What is claimed is:

1. In a reproduction apparatus including a fuser assembly having a pair of rollers in nip relation to apply heat and/or pressure to a receiver member bearing a marking particle image to fuse such marking particle image to such receiver member, a motor for rotating said pair of rollers to provide a drive in the roller nip to transport such receiver member through said fuser assembly, a mechanism for controlling the speed of the receiver member transported through said fuser assembly, said speed control mechanism comprising:

an input device for storing parameters required for fusing particular types of receiver members under various desired conditions;

a device for determining fuser control parameters, including overdrive effect, based on information from said input device and selection of a particular receiver member type and certain conditions; and a fuser assembly controller for setting fusing parameters based on the determination by said determining device, and for adjusting said motor for rotating said pair of rollers to set the transport speed of a receiver member through said fuser assembly to compensate for the determined overdrive effect.

2. The speed control mechanism of claim 1 wherein the overdrive effect is based on nip load parameter.

3. The speed control mechanism of claim 1 wherein said overdrive effect is based on nip width parameter.

4. The speed control mechanism of claim 1 wherein said input device and said determining device are integral with said fuser assembly controller.

5. In a reproduction apparatus including a fuser assembly having a pair of rollers in nip relation to apply heat and/or pressure to a receiver member bearing a marking particle image to fuse such marking particle image to such receiver member, a motor for rotating said pair of rollers to provide a drive in the roller nip to transport such receiver member, a method for controlling the speed of the receiver member through said fuser assembly, said method comprising the steps of:

providing information on parameters required for fusing particular receiver members under various conditions;

determining fuser control parameters, including overdrive effect, based on information from said input device and selection of a particular receiver member type and certain desired operating conditions; and setting fusing parameters based on the determination of a particular receiver member type and certain desired operating conditions, and adjusting the motor for rotating said pair of rollers to set speed of a receiver member through said fuser assembly to compensate for the determined overdrive effect.

6. The speed control mechanism of claim 5 wherein the overdrive effect is based on nip load parameter.

7. The speed control mechanism of claim 5 wherein said overdrive effect is based on nip width parameter.

* * * * *